United States Patent [19]

Satterwhite

[11] 4,003,148

[45] Jan. 18, 1977

[54] WHEEL EXCAVATOR WITH PIVOTALLY MOUNTED SIDE CUTTING TEETH

[75] Inventor: Charles R. Satterwhite, Dallas, Tex.

[73] Assignee: Unit Rig & Equipment Inc., Tulsa, Okla.

[22] Filed: Feb. 2, 1976

[21] Appl. No.: 654,654

Related U.S. Application Data

[63] Continuation of Ser. No. 596,679, July 17, 1975, abandoned, which is a continuation-in-part of Ser. No. 435,296, Jan. 21, 1974, Pat. No. 3,896,571.

[52] U.S. Cl. ..... 37/190; 37/96; 37/97

[51] Int. Cl.[2] ..... E02F 3/24

[58] Field of Search ..... 37/189, 190, 94–97, 37/91, 141 R, 141 T, DIG. 2, DIG. 16, 86; 198/12; 299/73–78

[56] References Cited

UNITED STATES PATENTS

| | | | |
|---|---|---|---|
| 853,985 | 5/1907 | Linga | 37/94 |
| 891,000 | 6/1908 | Omwake | 37/DIG. 2 |
| 937,994 | 10/1909 | Harding | 37/95 X |
| 1,222,754 | 4/1917 | Gerdeman | 37/DIG. 2 |
| 1,764,949 | 6/1930 | George | 37/DIG. 2 |
| 1,912,743 | 6/1933 | Vaughn | 37/DIG. 2 |
| R16,997 | 6/1928 | Barber | 37/DIG. 2 |

*Primary Examiner*—E. H. Eickholt
*Attorney, Agent, or Firm*—Richards, Harris and Medlock

[57] ABSTRACT

An excavating and loading system includes an excavating wheel assembly at the front thereof and a plurality of conveyors for conveying the material from the excavating wheel assembly upwardly and rearwardly. The excavating wheel assembly includes at least one excavating wheel which is positioned on the front of the vehicle with respect to the direction of travel to form an excavation. The wheel has side mounted cutting teeth which pivot outwardly to form an excavation wider than the following portion of the system. A supporting and housing apparatus rotatably supports the excavating wheel means from the vehicle and engages the wheel means on the ends thereof. Apparatus is provided for raising and lowering the excavation wheel assembly to raise and lower the excavation height and thereby vary the grade of the excavation. The excavation wheel is provided with means for positively moving the walls of a plurality of buckets between material receiving and material discharging positions.

20 Claims, 7 Drawing Figures

WHEEL EXCAVATOR WITH PIVOTALLY MOUNTED SIDE CUTTING TEETH

CROSS REFERENCE TO RELATED APPLICATION

This is a continuation of application Ser. No. 596,679, filed July 17, 1975, now abandoned, which in turn is a continuation-in-part of copending application Ser. No. 435,296, filed Jan. 21, 1974, for MULTI-WHEELED EXCAVATOR AND CONVEYING SYSTEM, now U.S. Pat. No. 3,896,571, granted July 29, 1975.

BACKGROUND AND SUMMARY OF THE INVENTION

The present invention relates to improvements in excavating and loading systems which form an excavation of a sufficient width to allow the following portion of the system to move through the excavation.

In large excavating and loading systems, for example, of the type capable of loading 4,000 cu. yds. of earth per hr., it has heretofore been known to utilize a system which forms a trench in the ground of a sufficient width to allow the system to move through the trench behind the excavating portion of the system. Although various examples of such excavating and loading systems have been designed previously, the need persists for a considerable improvement in the art.

In accordance with the broader aspects of the present invention, an improved excavating and loading system is disclosed including a vehicle and an excavating wheel assembly supported from the front of the vehicle. The excavating wheel assembly is provided with a plurality of buckets and has movable side walls which rotate outwardly to form a trench wider than the following portion of the system. A supporting and housing apparatus is mounted on the front of the vehicle and extends to support the excavating wheel assembly from the ends thereof.

In accordance with the preferred embodiment of the invention, an improved excavating and loading system is disclosed having a vehicle which comprises a main frame supported from the ground surface by driven wheels. A subframe is pivotally supported from the main frame so that the front end of the subframe can be vertically raised and lowered with respect to the main frame. A supporting and housing apparatus rotatably supports an excavation wheel assembly at the front of the vehicle. The supporting and housing apparatus has a yoke portion which engages the ends of the wheel assembly. A blade and a bearing plate are connected to the lower portions of the main and subframes for stabilizing the excavation wheel assembly. The excavating wheel assembly includes a plurality of digging buckets each having a wall which is supported for pivotal movement between the material receiving position and the material dumping position. Apparatus is provided for rotating the excavating wheel assembly and for operation of the movable wall of each bucket to first receive material and to subsequently dump the material and to transfer the material upwardly and rearwardly. Each of the buckets has movable side walls which pivot between digging and dumping positions. In the digging position, the side walls form an excavation which is wider than the excavation wheel itself and extends beyond the portion of supporting and housing means engaging the sides of the excavating wheel.

DESCRIPTION OF THE DRAWINGS

A more complete understanding of the present invention may be had by referring to the following Detailed Description when taken in conjunction with the accompanying Drawings wherein.

DETAILED DESCRIPTION

Figure 1:
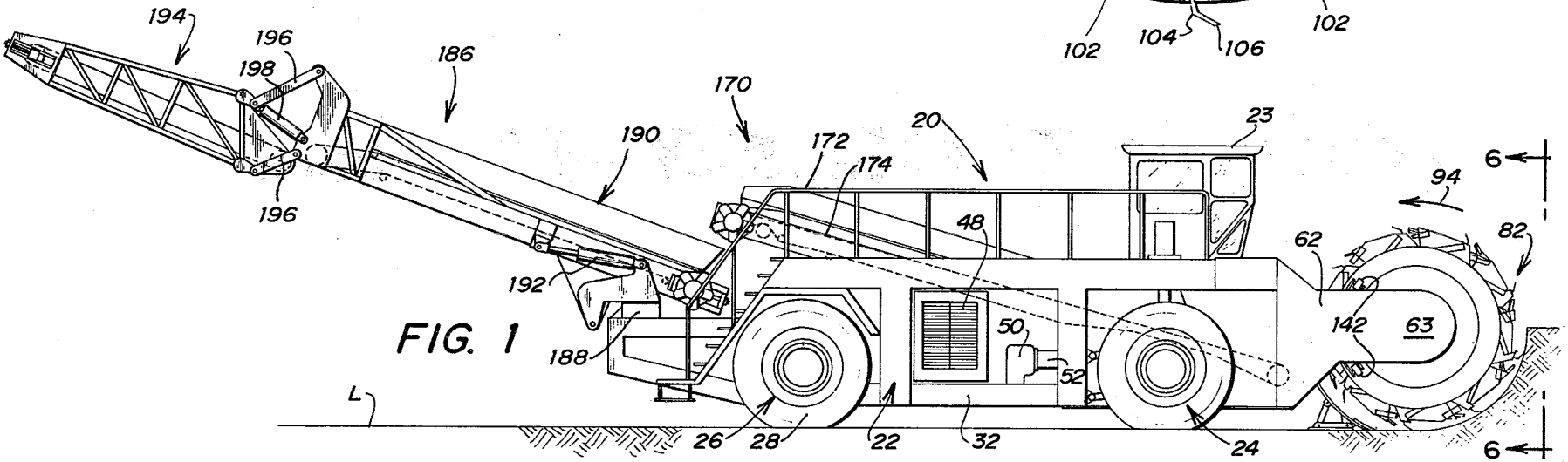
FIG. 1 is a side elevation of an excavating and loading system comprising the present invention.

Referring now to the Drawings, and particularly to FIG. 1, an excavating and loading system 20 incorporating the present invention is shown. The system 20 comprises a vehicle 22 with an operator cab 23 and front wheels 24 and rear wheels 26 for movement along a surface L. Each of the wheels 24 and 26 comprises a pneumatic tire 28 whereby the excavating and loading system 20 is adapted for movement over highways and other paved surfaces as well as for operation in unpaved areas, such as during an excavating operation. It is to be understood, of course, that other types of wheels such as a track type could be used.

Figure 2:
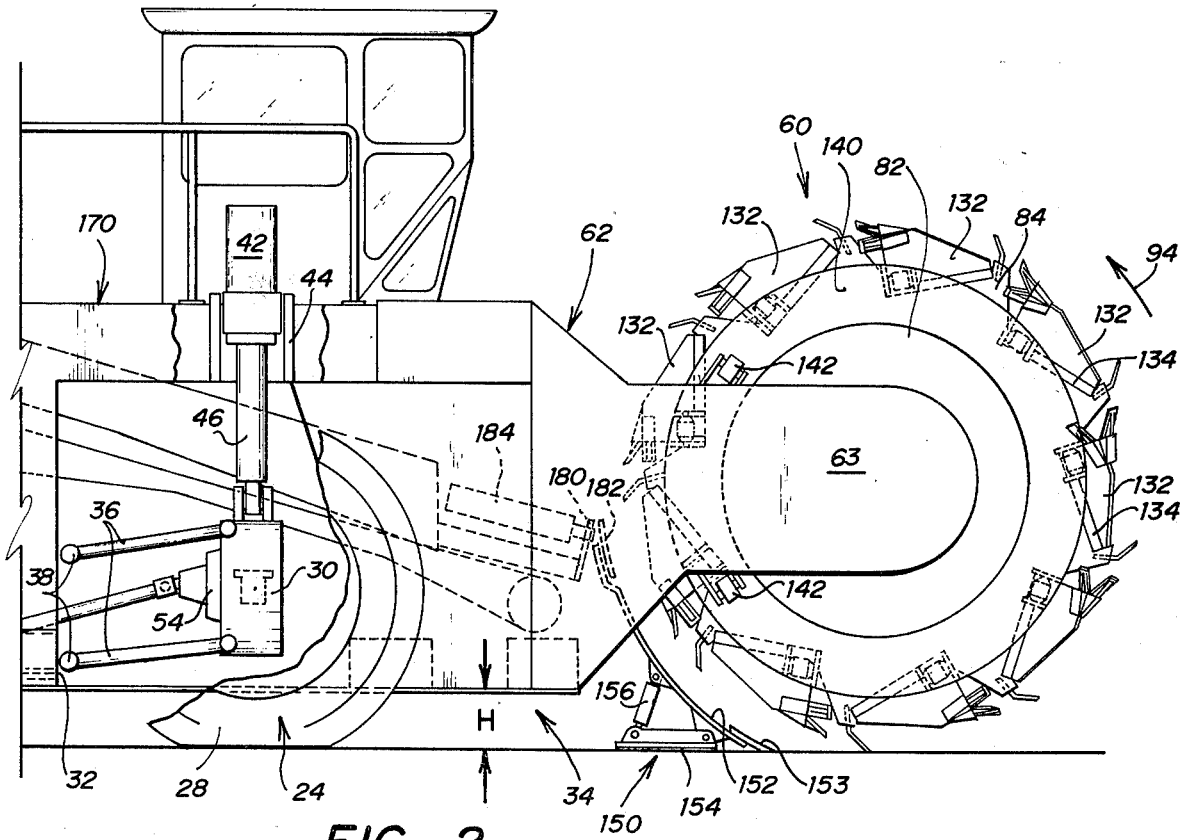
FIG. 2 is a partial enlarged side elevation of the front portion of the excavating and loading system illustrated in FIG. 1.

As is best illustrated in FIG. 2, the front wheels 24 are supported from a main frame 30. The rear wheels 26 are supported from a subframe 32. The main frame 30 comprises a rigid elongated member which extends between the front wheels 24 in a horizontal direction. A pair of link bars 36 are connected between each side of the main frame 30 and the subframe 32. Link bars 36 are positioned to extend in a spaced parallel relationship with their ends connected at 38 to the subframe 32 to pivot about horizontal axes. A pair of double-acting variable length hydraulic cylinder assemblies 42 are connected to the subframe 32 by flanges 44. The rods 46 of the hydraulic cylinder assemblies 42 are connected to the main frame 30. By selectively actuating cylinders 42, the height H of the front end 34 of the subframe 32 can be raised or lowered. It is envisioned, of course, that the vehicle 22 could be provided with other types of wheels and frame structures as are well known in the art.

In accordance with the illustrated embodiment of the invention, an engine 48 is supported on the subframe 32. The engine 48 is preferably of the internal combustion type and functions to drive a plurality of hydraulic pumps. The hydraulic pumps in turn supply operating power through suitable controls in cab 23 for the various components of the excavating and loading system 20. For example, one of the pumps supplies operating power for hydrostatic drive 50. Hydrostatic drive 50 is coupled to a transmission 52. The transmission 52 provides dual outputs which are coupled to the forward differential 54 which in turn is coupled to the front wheels 24 and a rear differential (not shown) coupled to the rear wheels 26. Thus, the hydrostatic drive 50 operates wheels 24 and 26 to propel the excavating and loading system 20 during excavating operations and during travel. In this embodiment, the front wheels are provided with conventional steering mechanism for manipulating the vehicle as desired. If additional control over the vehicle is desired, rear wheel steering can also be provided.

Figure 4:
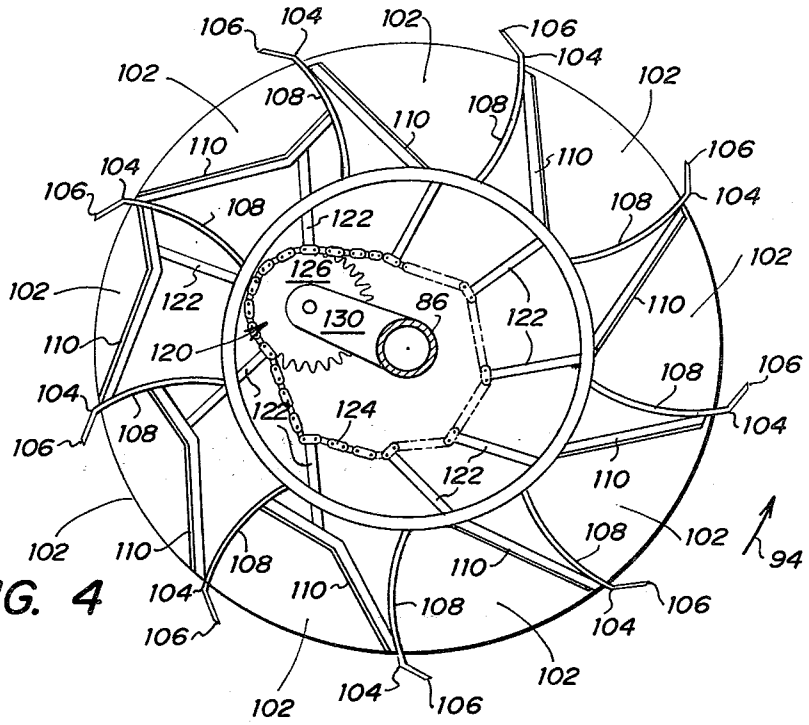
FIG. 4 is a sectional view taken on line 4—4 of FIG. 3, looking in the direction of the arrows.
Figure 3:
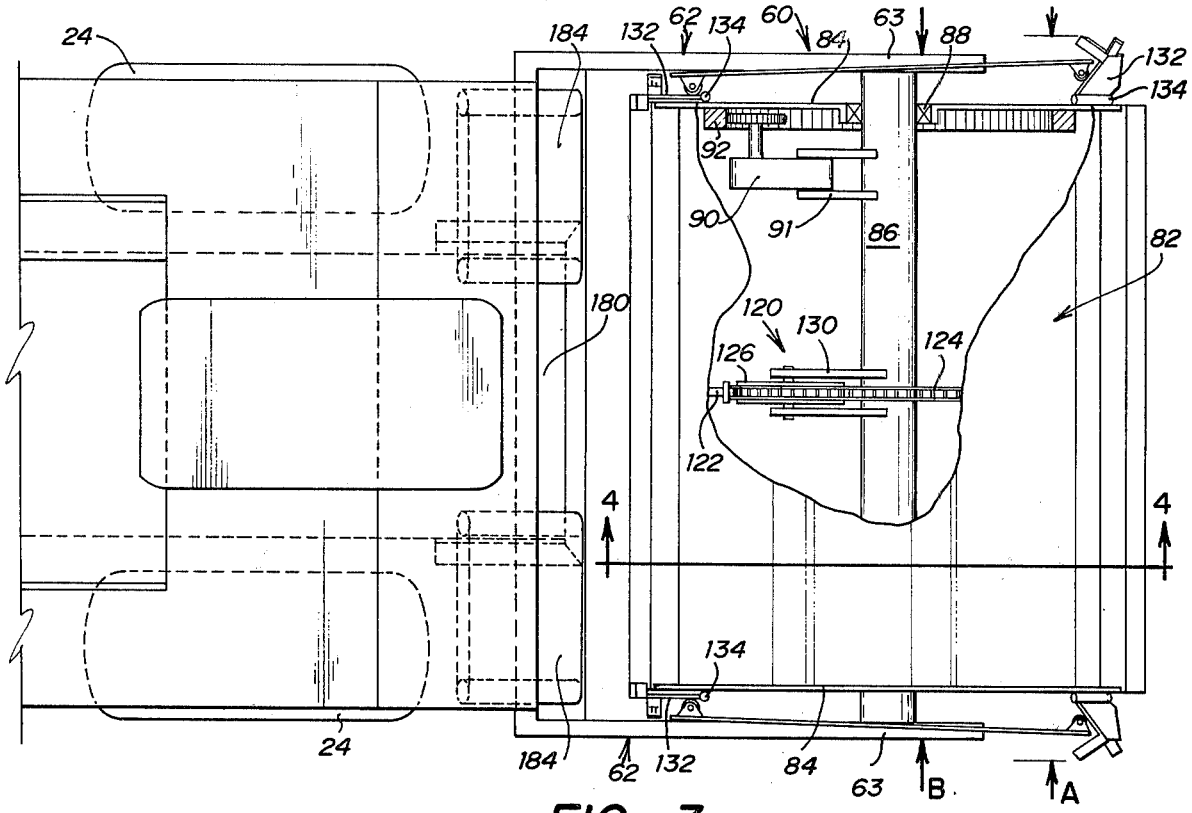
FIG. 3 is a partial enlarged plan view of the front portion of the excavating and loading system illustrated in FIG. 1.

An excavating wheel assembly 60 comprises the forward portion of the excavating and loading system 20. The excavating wheel assembly 60 includes a yoke 62 supported from the front of the subframe 32. As is illustrated in FIG. 3, an excavating wheel 82 is supported from the yoke 62 for rotation about a horizontally extending axis. The excavating wheel 82 includes a pair of rims 84 which extend radially outward along a portion of the sides of the wheel. A shaft 86 is fixed to the yoke and extends in a horizontal direction between wheel engaging portions 63 of the yoke 62. Each of the rims 84 is rotatably supported from the shaft 86 by bearings 88. A pair of hydraulic motors 90 are each positioned inside the wheel 82 and are supported from flanges 91 in a fixed angular position relative to shaft 86. A pair of internal ring gears 92 is likewise positioned inside the wheel 82 adjacent to the rims 84. Each of the motors 90 is provided with an output sprocket which engages one of the two ring gears mounted inside the wheel 82 to cause the wheel to rotate in the direction of arrow 94 as shown in FIGS. 2 and 4. Hydraulic lines communicating with the motors 90 extend through the yoke 62.

It is envisioned, of course, that the wheel 82 could alternatively be driven by electrical motors, power for which is derived from a generator driven by engine 48.

As shown in FIG. 4, the wheel 82 further includes a plurality of digging buckets 102 which are equally spaced circumferentially around the wheel 82 and extend between the rims 84. The digging buckets 102 each have a cutting edge 104 including a plurality of teeth 106 and a stationary front wall 108, extending generally radially inward from the cutting edge 104. Each digging bucket further includes a rear wall 110, which is supported for pivotal movement between the material receiving position and a material discharge position. The operation of the rear wall 110 is best shown in FIG. 4, wherein the wall is shown manipulated between the material receiving position where the respective buckets 102 are in the lower and forward position of their rotary motion and to a material discharge position when the respective buckets are in the upper and rearward position of their rotary motion.

Referring particularly to FIGS. 3 and 4, an actuating system 120 for the digging buckets is shown. The system 120 is located completely within the margin of the wheel 82 and comprises a plurality of push rods 122, each of which is connected between one of the rear walls 110 and a chain 124. The chain 124 is generally constrained and extends around a roller 126 which is supported on shaft 86 and which is secured against angular movement relative to shaft 86 by brackets 130. The roller 126 is sprocketed on its outer periphery to engage the chain 124. An excavating wheel 82 is rotated about the shaft 86 under the action of motors 90, each push rod 122 comes into engagement with the roller 126 whereupon its respective rear wall 110 is pushed outwardly to the material dumping position. Subsequently, as each digging bucket is rotated to the lower and forward position of the circular path, the chain operates through the push rod 122 to positively return the rear wall 110 to the material receiving position. This positive action of the rear wall 110 in both directions has been found to be vastly superior to the arrangements that have been used heretofore wherein the rear portions were allowed to return to the material receiving position under the action of gravity. It is envisioned, of course, that other positive acting actuating systems could be used such as those described in the earlier copending application, Ser. No. 435,296, filed Jan. 21, 1974, for MULTI-WHEELED EXCAVATOR AND CONVEYING SYSTEM, now U.S. Pat. No. 3,896,571, granted July 29, 1975.

Figure 5:
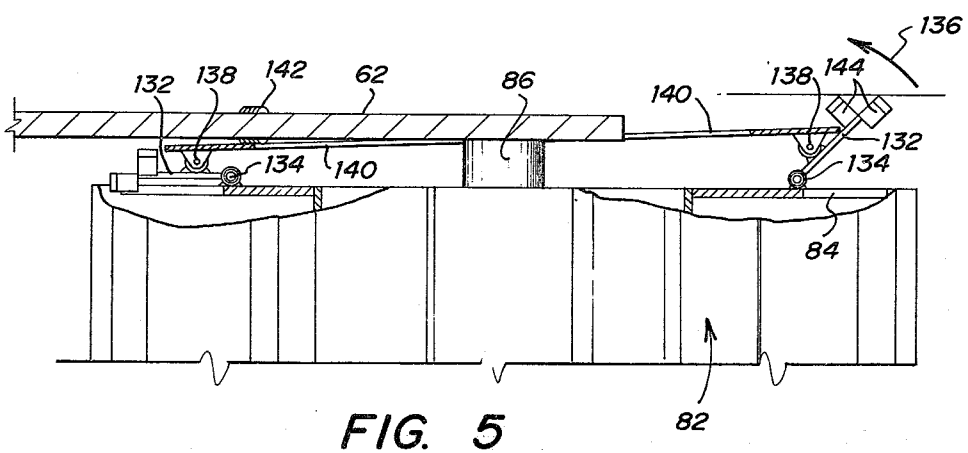
FIG. 5 is an enlarged plan view of a portion of the excavating wheel illustrated in FIG. 3.

According to a particular feature of the present invention, each of the buckets is provided with movable side walls 132. These side walls 132 are shown in FIGS. 2, 3, 5 and 6. Each side wall 132 is pivotally connected to the rim 84 by a bushing 134. The side walls 132 have a general triangular shape and the bushing 134 allows the side walls to rotate in the forward and reverse direction of arrow 136 as shown in FIG. 5. Resilient bushings 138 connect each of the side walls 132 to a ring 140 positioned on either side of the excavating wheel 82. Each of the rings 140 is positioned between the outside of one of the rims 84 and the respective portions 63 of the yoke 62 as shown in FIG. 5. A pair of guide rollers 142 is mounted on the inside surface of each portion 63 of the yoke 62 to engage the ring as shown in FIGS. 2 and 5.

As is best shown in FIG. 5, the distance between opposite bushings 138 on the ring 140 is less than the distance between their connections to opposite bucket walls when in the closed position. Due to this configuration, at all times during rotation of the excavating wheel 82, some of the side walls 132 will be in the open or digging position as shown in the right-hand portion of FIG. 5. The rollers 142 contact the outer extending surface of the rings 140 and move the side walls 132 to the closed position to allow clearance under the yoke portion 152 as illustrated in FIG. 5.

In addition, each of the side walls 132 has a pair of digging teeth 144 which extend from the outer periphery of the wall for excavating material during rotation of the wheel 82. The side walls 132 and the ring 140 are arranged so that when the individual buckets 102 are in the material receiving position, the walls 132 will be rotated to their maximum side-to-side digging width. This allows the excavating wheel 82 to form an excavation which is wider than the overall width of the excavating wheel itself. In addition, the ring structure is directly connected to each of the side walls to provide a positive actuating system for moving the side walls 132.

Figure 6:
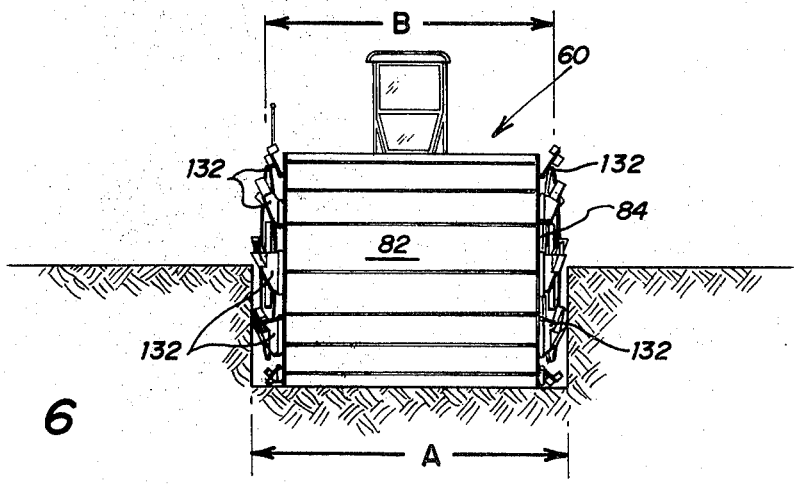
FIG. 6 is a sectional view taken on line 6—6 of FIG. 1, looking in the direction of the arrows.

The outward rotational movement of the side walls 132 will cause the excavating wheel 82 to form an excavation of a width A as shown in FIG. 6. The maximum width of the following portion of the vehicle B is measured by the outside surface of the portions 63 of the yoke 62. The advantages of this particular excavating wheel assembly are three-fold: First, it increases the width of the excavation being formed by the system, thus permitting operation of the excavating and loading system within the trench as being formed. This materially reduces the amount of movement of the excavating wheel assembly necessary to position the assembly for excavation and travel, and thereby reduces the overall complexity of the excavating and loading system incorporating the present invention. Second, it allows the use of a yoke-type supporting and housing means which engages the excavating wheel at the ends thereof providing a more stable means for supporting the excavating wheel which materially reduces the weight and overall complexity of the excavating and loading system incorporating the present invention. Third, it allows the use of a positive bucket side wall actuation system vastly superior to other actuating systems for side walls or buckets.

Positioned below and behind the excavating wheel 82 is a moldboard assembly 150. This moldboard assembly extends completely across the width of the wheel 82 and is provided to pick up loose material and crowd material in a forward direction as the excavating and loading system moves. The assembly comprises a plate 152, which is curved to conform to the path of travel of the edges 104. A blade 153 is positioned adjacent the lower edge of the plate 152. The plate 152 is rigidly supported from the yoke 62. A bearing plate 154 is pivotally supported at its leading edge from the rear of the plate 152. A selectively operable double-acting hydraulic cylinder means 156 is pivotally attached between the trailing edge of the plate 154 and the plate 152.

Thus, by manipulating control means provided within the cab 23, the effective length of the hydraulic cylinder 156 can be selectively varied to appropriately position the bearing plate 154 with respect to the yoke 62 as desired. This bearing plate can be adjusted to set the vertical pressure of the plate to reduce bouncing and stabilize the excavating system.

Figure 7:
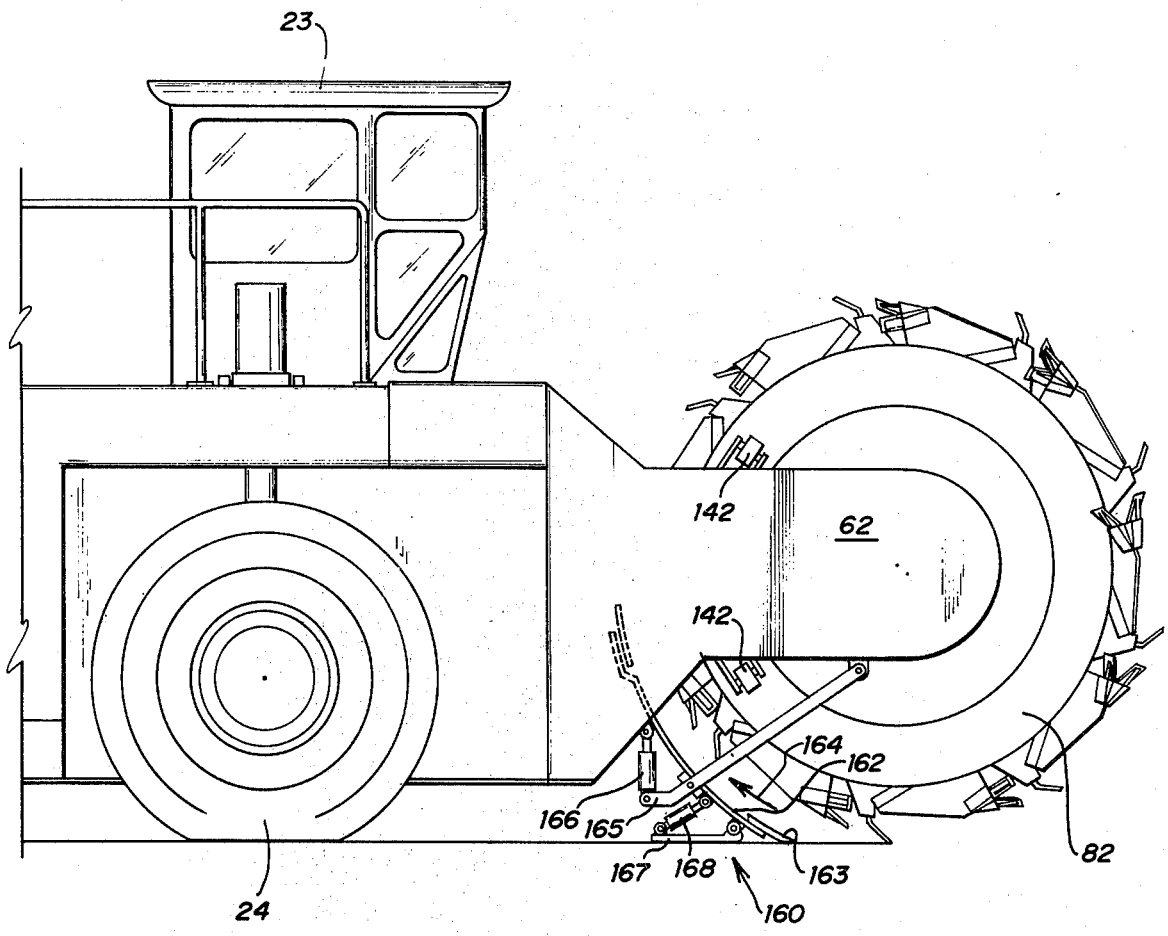
FIG. 7 is a view similar to FIG. 3 illustrated in an alternate embodiment of the present invention.

In FIG. 7, an alternate configuration of a moldboard assembly is illustrated. This moldboard assembly 160 likewise extends completely across the width of the wheel 82 and is provided to pick up loose material and crowd material in a forward direction as the system 20 moves. The assembly 160 comprises a plate 162 which is curved to conform with the path of the travel of the edges 104. A blade 163 is positioned adjacent the lower edge of the plate 162. The plate 162 is slidably supported from the yoke 62 to move in the forward and reverse directions of the arrows 164. A pair of link arms 165 are pivotally coupled between the yoke 62 and the plate 162. The double-acting hydraulic cylinder means 166 is pivotally connected between each of the arms 165 and the yoke 62. Thus, by manipulating control means provided in cab 23, the effective length of hydraulic cylinder 166 can be selectively varied to appropriately position the plate 162 and blade 163 as desired.

A bearing plate 167 has its leading edge pivotally attached to the rear of the plate 162. A selectively operable double-acting hydraulic cylinder means 168 is pivotally attached between the trailing edge of the bearing plate 167 and the plate 162.

Thus, by manipulating control means provided in the cab 23, the effective length of the hydraulic cylinder means 168 can be selectively varied to appropriately position the bearing plate 167 with respect to the yoke 62 as desired. This bearing plate can be adjusted to set the vertical pressure of the plate to reduce bounce and to stabilize the excavating system.

As is illustrated in FIGS. 1 and 2, the excavating and loading system 20 further includes a loading system 170. The loading system 170 includes a main conveyor 172 comprising an endless belt 174 mounted for movement around a course extending angularly upward relative to the subframe 32 of the vehicle 22 and including a lower material receiving portion and upper material delivery portion. More particularly, the course of belt 174 is defined by a plurality of rollers (not shown) which are supported on the frame of the conveyor 172. The frame of the conveyor 172 is supported from the subframe 32 of the vehicle 22 and includes means supporting the upper portion for pivotal movement about a horizontal axis under the action of a hydraulic cylinder (not shown). This permits control of the vertical height and allows folding of the material delivery portion of the conveyor.

Belt 174 of the main conveyor 172 extends around drums mounted at either end of the conveyor. These drums are rotated by radial hydraulic motors (not shown) and by this means, the belt 174 is moved around the course defined by rollers to move material from the material receiving portion to the material discharge or delivery portion.

A chute 180 is supported from the yoke 62 behind and below the excavating wheel 82 to receive material discharge from the buckets 102. The chute 180 is shaped to direct the material onto the material receiving portion of the main conveyor 172 and has a plate 182, which cooperates with and overlaps the plate 152. This chute 180 directs material excavated by the excavating wheel 82 to the main conveyor 172 for transportation thereby from the material receiving portion to the material delivery portion. In addition, transversely extending conveyors 184 can be provided to assist in moving material onto the main conveyor 172.

Referring now particularly to FIG. 1, the disclosed embodiment of the invention further includes an auxiliary conveyor system 186. The auxiliary conveyor system 186 includes a frame which is secured to the rear end of the subframe 32 of the vehicle 22. A turntable 188 supports the frame of the auxiliary conveyor 186 for pivotal movement about a vertical axis under the action of a hydraulic motor (not shown).

An inner conveyor 190 supported on the turntable 188 receives material discharged from the material delivery portion of the main conveyor 172. The conveyor 190 comprises a frame which is supported on the turntable 188 and an endless belt for movement around a course defined by a plurality of rollers. The belt is driven by hydraulic motors and a hydraulic cylinder 192 is provided for controlling the angular relationship of the auxiliary conveyor 186 and the turntable 188.

The auxiliary conveyor system 186 further includes an outer conveyor 194 having a frame which is supported from the frame of the inner conveyor 190 by upper and lower parallel links 196. An endless belt is supported on the frame of the outer conveyor for movement around the course defined by drums on either end thereof.

A hydraulic cylinder 198 is pivotally connected between the frames of the inner and outer conveyors to manipulate the outer conveyor 194 with respect to the inner conveyor 190. In this manner, the outer conveyor 194 may be manipulated to selectively receive material from the inner conveyor 190.

It is to be understood that the conveyors 190 and 194 could be driven by electrical motor or mechanically coupled to and driven by movement of the excavating wheel means.

As will be understood, the present invention comprises additional improvements relating to excavating and loading systems disclosed and claimed in copending application, Ser. No. 435,296, filed Jan. 21, 1974, for MULTI-WHEELED EXCAVATOR AND CONVEYING SYSTEM, now U.S. Pat. No. 3,896,571, granted July 29, 1975.

Thus, in accordance with the invention described herein, an excavating and loading system comprising a vehicle having an excavating wheel assembly supported on the front thereof is provided for excavating material and transporting material to a main conveyor whereupon the material is conveyed to the rear of the vehicle. A supporting and housing apparatus is provided for supporting an excavating wheel from the front of the vehicle. The supporting and housing apparatus has portions which engage and support the wheel from the ends. The excavating wheel has a plurality of buckets with movable side walls which pivot out to form an excavation wider than the wheel engaging portion of the supporting and housing apparatus. In this manner, the excavating wheel forms an excavation wider than the following portion of the vehicle allowing the vehicle to be supported in and travel through the excavation as it is being formed.

Although the particular embodiments of the invention have been illustrated in the accompanying Drawings and described in the foregoing Detailed Description, it will be understood that the invention is not limited to the embodiment disclosed but is capable of numerous rearrangements, modifications and substitutions of parts and elements without departing from the spirit and scope of the invention as defined in the appended claims.

What is claimed is:

1. An excavating and loading system comprising in combination:

a vehicle;

means supporting the vehicle for movement over a surface;

excavating wheel means for forming an excavation including a plurality of digging buckets each having a cutting edge which extends to the stationary rear wall and a movable front wall mounted for pivotal movement from a material receiving position to a material dumping position, movable side walls mounted for pivotal movement between a first material receiving position wherein the walls pivot outward wider than the widest portion of the vehicle and a second material discharge position wherein the walls pivot inward to a position flush with the side of the wheel means;

means pivotally attached to said vehicle and supporting the excavating wheel means on the vehicle whereby the excavating wheel means is positioned in the front of the vehicle, said means supporting said excavating wheel having portions extending axially out from and engaging the ends of the excavating wheel means;

means for selectively varying the relative position of said excavating wheel means and said vehicle whereby said excavating wheel means can be selectively raised or lowered to excavate at various depths;

drive means for rotating the excavating wheel means so that the digging buckets follow a circular path;

means located within the margins of the excavating wheel means and responsive to rotation thereof for positively positioning the movable front wall of each digging bucket in the material dumping position when the bucket is in the upper and rearward portion of the path and for positively positioning the movable side walls in the material digging and dumping positions; and conveyor means mounted on the vehicle entirely behind the excavating wheel assembly for movement around a course including a relatively low portion positioned to receive material from the digging buckets of the excavating wheel means and a relatively high discharge position located rearwardly on the vehicle.

2. The excavating and loading system according to claim 1 wherein the vehicle includes a frame and engine means mounted on the frame, wherein the vehicle supporting means comprises wheel means, and further including means operatively interconnecting the engine means and the wheel means for effecting propulsion of the vehicle.

3. The excavating and loading system according to claim 1 wherein the excavating wheel means drive means includes means operatively connecting the excavating wheel means to the engine means whereby the engine means effects rotation of the excavating wheel means.

4. The excavating and loading system according to claim 1 wherein the excavating wheel means comprises a plurality of digging buckets positioned immediately adjacent one another to define the entire periphery of the excavating wheel means.

5. The excavating and loading system according to claim 4 wherein the digging buckets of the excavating wheel means each extend substantially continuously between the movable side walls.

6. The excavating and loading system according to claim 2 wherein the means rotatably supporting the excavating wheel means on the vehicle include:

a pair of arms extending forwardly from the vehicle;

axle means extending transversely between the distal ends of the arms; and bearing means rotatably supporting the excavating wheel means on the axle means.

7. The excavating and loading system according to claim 2 wherein the drive means for rotating the excavating wheel means includes motor means positioned within the excavating wheel means.

8. The excavating and loading system according to claim 2 wherein the means for positively positioning the movable walls of the digging buckets includes:

a plurality of push rods each secured to one of the movable walls;

chain means interconnecting all of the push rods; and sprocket means engaging the chain means and positioned to effect actuation of the push rods and thereby move the pivotal walls of the digging buckets to the material dumping position.

9. The excavating and loading system according to claim 1 wherein the means for positively positioning the movable side walls of the digging buckets in material digging and dumping positions includes:

ring means positioned at the opposite ends of the excavating wheel means and pivotally interconnected to the movable side walls of each digging bucket; and roller means mounted on the portions of the excavating wheel supporting means which extend axially outwardly and engaging the ring means whereby each side wall of each digging bucket is pivoted between the material digging and dumping positions responsive to rotation of the excavating wheel means.

10. The excavating and loading system according to claim 1 wherein the conveyor means includes main conveyor means centrally disposed on and extending longitudinally with respect to the vehicle and cross conveyor means for receiving material from the outside portions of the excavating wheel means and delivering the material to the main conveyor means.

11. An excavating and loading system comprising in combination:

a vehicle including a main frame and engine means;

wheel means mounted on the main frame of the vehicle and supporting the vehicle for movement over a surface;

means operatively interconnecting the engine means and the wheel means for propelling the vehicle;

excavating wheel means for forming an excavation and including a plurality of digging buckets each having a cutting edge which extends to a stationary rear wall and a movable front wall mounted for pivotal movement between material receiving and material dumping positions, movable side walls each mounted for pivotal movement between a material receiving position wherein the wall is pivoted outwardly to a point wider than the widest portion of the vehicle and a material discharge position wherein the wall is pivoted inward to a position flush with the adjacent side of the excavating wheel means;

means attached to the vehicle and rotatably supporting the excavating wheel means on the vehicle whereby the excavating wheel means is positioned in front of the vehicle, said means supporting the excavating wheel means having portions extending axially outwardly from the vehicle adjacent the opposite ends of the excavating wheel means and engaging the ends of the excavating wheel means;

means for selectively varying the relative positioning of the excavating wheel means and the wheel means which support the vehicle whereby the excavating wheel means may be selectively raised or lowered to vary the grade of the excavation formed thereby;

guide means for rotating the excavating wheel means so that the digging buckets thereof follow a circular path;

means located within the margins of the excavating wheel means and responsive to rotation thereof for positively positioning the movable front wall of each digging bucket in the material dumping position when the bucket is in the upward and rearward portion of the circular path;

means responsive to rotation of the excavating wheel means for positively pivoting the movable side walls of each digging bucket between the material digging and the material dumping positions; and conveyor means mounted on the vehicle behind the excavating wheel means for movement around a course including a relatively low portion positioned to receive material from the digging buckets of the excavating wheel means and a relatively high discharge portion located rearwardly on the vehicle.

12. The excavating and loading system according to claim 11 wherein the drive means functions to operatively interconnect the engine means and the excavating wheel means whereby the excavating wheel means is rotated under the action of the engine means.

13. The excavating and loading system according to claim 11 wherein the excavating wheel means comprises a plurality of digging buckets positioned immediately adjacent one another to define the entire periphery of the excavating wheel means.

14. The excavating and loading system according to claim 13 wherein the digging buckets of the excavating wheel means each extend substantially continuously between the movable side walls.

15. The excavating and loading system according to claim 11 wherein the means for supporting the excavating wheel means at the front of the vehicle includes a pair of arms extending forwardly from the vehicle, axle means extending between the distal ends of the arms, and bearing means rotatably supporting the excavating wheel means on the axle means.

16. The excavating and loading system according to claim 11 wherein the means for selectively varying the relative positioning of the excavating wheel means and the vehicle supporting means includes means for selectively varying the positioning of the vehicle supporting means relative to the frame of the vehicle.

17. The excavating and loading system according to claim 11 wherein the drive means includes motor means mounted within the excavating wheel means.

18. The excavating and loading system according to claim 11 wherein the means for positively positioning the movable walls of the digging buckets includes:

a plurality of push rods each secured to one of the movable walls;

chain means interconnecting all of the push rods; and sprocket means engaging the chain means and positioned to effect actuation of the push rods and thereby move the pivotal walls of the digging buckets to the material dumping position.

19. The excavating and loading system according to claim 11 wherein the portions of the excavating wheel supporting means which extend axially outwardly have rollers mounted thereon, and wherein the means for positively positioning the movable side walls of the digging buckets includes ring means pivotally connected to the movable side walls of the digging buckets at each end of the excavating wheel means and mounted in engagement with the roller means whereby the movable side walls are pivoted outwardly during the forward portion of the circular path of the rotation of the digging buckets and are pivoted inwardly to clear the outwardly extending portions of the excavating wheel supporting means during the rearward portion of the rotation of the digging buckets.

20. The excavating and loading system according to claim 11 wherein the conveyor means includes a main conveyor mounted on and centrally disposed relative to the frame of the vehicle and means for directing material from the outer portions of the excavating wheel means to the main conveyor means.

* * * * *

UNITED STATES PATENT OFFICE

CERTIFICATE OF CORRECTION

Patent No. 4,003,148 Dated January 18, 1977

Inventor(s) Charles R. Satterwhite

It is certified that error appears in the above-identified patent and that said Letters Patent are hereby corrected as shown below:

Column 8, line 33 "claim 2" should be --claim 1--;
Column 8, line 41 "claim 2" should be --claim 1--;
Column 8, line 45 "claim 2" should be --claim 1--.

Signed and Sealed this twenty-sixth Day of July 1977

[SEAL]

Attest:

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 4,003,148

DATED : January 18, 1977

INVENTOR(S) : Charles R. Satterwhite

It is certified that error appears in the above-identified patent and that said Letters Patent are hereby corrected as shown below:

The Assignee should be --Unit Rig & Equipment Co.--
instead of "Unit Rig & Equipment Inc."

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*